US009548149B2

(12) United States Patent
Kato et al.

(10) Patent No.: US 9,548,149 B2
(45) Date of Patent: Jan. 17, 2017

(54) RARE EARTH BASED MAGNET

(71) Applicant: TDK CORPORATION, Tokyo (JP)

(72) Inventors: Eiji Kato, Tokyo (JP); Yoshinori Fujikawa, Tokyo (JP); Taeko Tsubokura, Tokyo (JP); Chikara Ishizaka, Tokyo (JP); Katsuo Sato, Ichikawa (JP)

(73) Assignee: TDK CORPORATION, Tokyo (JP)

( * ) Notice: Subject to any disclaimer, the term of this patent is extended or adjusted under 35 U.S.C. 154(b) by 52 days.

(21) Appl. No.: 14/229,296

(22) Filed: Mar. 28, 2014

(65) Prior Publication Data

US 2014/0292454 A1 Oct. 2, 2014

(30) Foreign Application Priority Data

Mar. 28, 2013 (JP) ..... 2013-067859
Dec. 20, 2013 (JP) ..... 2013-263370
Mar. 25, 2014 (JP) ..... 2014-061533

(51) Int. Cl.
*H01F 1/057* (2006.01)

(52) U.S. Cl.
CPC ..... *H01F 1/0571* (2013.01); *H01F 1/0577* (2013.01)

(58) Field of Classification Search
CPC ..... H01F 1/00; H01F 7/00; H01F 1/0571; H01F 1/0577; B22F 2999/00
USPC ..... 148/302
See application file for complete search history.

(56) References Cited

U.S. PATENT DOCUMENTS 7,199,690 B2 * 4/2007 Hidaka ..... H01F 1/0577 148/302
2009/0081071 A1 * 3/2009 Yamamoto ..... B22F 9/007 420/83

FOREIGN PATENT DOCUMENTS

JP B2-2893265 5/1999
JP A-2002-327255 11/2002
JP A-2009-242936 10/2009

* cited by examiner

*Primary Examiner* — Weiping Zhu
(74) *Attorney, Agent, or Firm* — Oliff PLC

(57) ABSTRACT

The present invention provides a rare earth based magnet having a microstructure in which in a section of the $R_2T_{14}B$ main-phase crystal grains, the number density of the fine products in the interior of (inside) the crystal grains is larger than that in the periphery of (outside) the crystal grains. That is, the rare earth based magnet includes $R_2T_{14}B$ main-phase crystal grains and grain boundary phases formed between the $R_2T_{14}B$ main-phase crystal grains. The $R_2T_{14}B$ main-phase crystal grains include a substance where fine products are formed in the crystal grains. In the section of the main-phase crystal grains, when the crystal grains are divided into the interior of the crystal grains and the periphery of the crystal grains with a specific ellipse, the fine products are formed such that the number density in the interior is larger than that in the periphery.

10 Claims, 1 Drawing Sheet

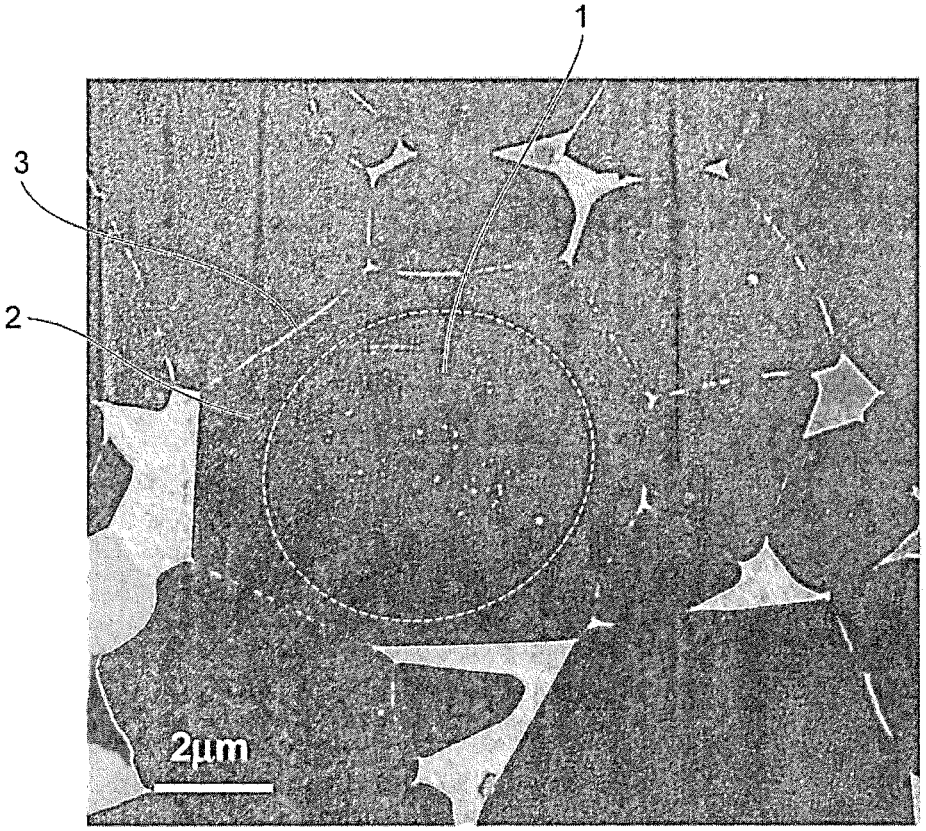
1
3
2
2μm

RARE EARTH BASED MAGNET

The present invention relates to a rare earth based magnet, specifically a microstructure of the R-T-B based sintered magnet.

BACKGROUND

The R-T-B based sintered magnet (R represents a rare earth element, T represents one or more elements of iron group with Fe being an essential element, and B represents boron), a representative of which is Nd—Fe—B based sintered magnet, is advantageous for miniaturization and high efficiency of the machines used due to high saturation magnetic flux density, and thus can be used in a voice coil motor of a hard disk drive, etc. In recent years, the R-T-B based sintered magnet has been applicable in various industrial motors, driving motors of the hybrid vehicles, or the like. From the viewpoint of energy saving, it is desirable that the R-T-B based sintered magnet can be further popularized in these fields. However, when applied in the hybrid vehicles and the like, the R-T-B based sintered magnet will be exposed to a high temperature, and thus suppression on demagnetization at high temperature caused by heat becomes important. In the suppression on demagnetization at high temperature, a method of sufficiently improving the coercivity of the R-T-B based sintered magnet at a room temperature is well known as effective.

For example, as a method for improving the coercivity of the Nd—Fe—B based sintered magnet at a room temperature, a method in which part of Nd of the compound $Nd_2Fe_{14}B$ which acts as the main phase is replaced with heavy rare earth elements such as Dy and Tb is well known. By replacing part of Nd with the heavy rare earth elements, the magneto-crystalline anisotropy is increased, and as a result, the coercivity of the Nd—Fe—B based sintered magnet at a room temperature can be sufficiently improved. In addition to the replacement with heavy rare earth elements, addition of elements such as Cu is also effective in improving the coercivity at a room temperature (Patent Document 1). By addition of element Cu, the element Cu forms, e.g., Nd—Cu liquid phase in the grain boundary, and thus the grain boundary is smoothened, inhibiting the occurrence of the reverse magnetic domains.

It is pointed out that, in order to improve the coercivity of the rare earth based magnet, inhibition on the movement of the magnetic domain wall of the occurred reverse magnetic domain is important, too. For example, Patent Document 2 has disclosed a technique in which fine magnetically hardening products of a non-magnetic phase are formed in the grains of the main phase $R_2T_{14}B$, and thus magnetic domain wall pinning is performed, thereby improving the coercivity. Moreover, Patent Document 3 has disclosed a technique for improving the coercivity by forming a magnetically modulated portion in the main-phase crystal grains, based on the same technical idea as Reference 2.

PATENT DOCUMENTS

Patent Document 1: Japanese Patent JP-A No. 2002-327255
Patent Document 2: JP 2893265
Patent Document 3: Japanese Patent JP-A No. 2009-242936

SUMMARY

In the case of using the R-T-B based sintered magnet at a high temperature of 100° C.~200° C., the value of the coercivity at a room temperature is one of the effective indicators, and it is also important that no demagnetization or little demagnetization occurs even when practically exposed to a high temperature environment. Although the coercivity of the composition where part of R of the compound $R_2T_{14}B$ which acts as the main phase is replaced by the heavy rare earth elements such as Dy or Tb is improved remarkably and this is a simple method to get a high coercivity, there are problems in the resources since the heavy rare earth elements such as Dy and Tb are limited in geographical origins and yields. Accompanying with the replacement, it is unavoidable for the residual magnetic flux density to decrease due to antiferromagnetic coupling of Nd and Dy. Addition of Cu as described above and the like are also effective to get a high coercivity. Nonetheless, in order to enlarge the applicable field of the R-T-B based sintered magnet, it is desirable that the suppression on demagnetization at high temperature (demagnetization due to exposure to a high temperature environment) is further enhanced.

With respect to the R-T-B based sintered magnet, in addition to the method of adding Cu, all the methods that can supplement a pinning mechanism for the magnetic domain wall are expected to further improve the coercivity. However, from the experiments of the present inventors and the like, it is known that if the products are formed only in the main-phase grains, the coercivity is not sufficiently improved. This is possibly because the formation of products in the main-phase grains increases nuclei for generating the reverse magnetic domain instead.

Patent Document 3 provides several clues regarding characteristics of the portion, the magnetic property of which is altered, formed in the main-phase crystal grains, i.e., the defective structures. In this way, in order that the defective structures can effectively inhibit the movement of the magnetic domain wall, number density of the defective structures is important. In order to ensure the number density of the necessary defective structures and not to decrease the volume fraction of the ferromagnetic phase, the size of the defective structures is required to be reduced to certain extent. However, there is no disclosure about how to distribute the defective structures.

The present invention has been accomplished in view of the above situation, and its purpose is to extremely enhance the suppression on demagnetization at high temperature in the R-T-B based sintered magnet, i.e., the rare earth based magnet.

To achieve the above purpose, the present inventors have made an effort to investigate the relationship between the microstructure of the R-T-B based sintered magnet and the rate of demagnetization at high temperature, and found that the rate of demagnetization at high temperature can be suppressed by controlling distribution of the fine products formed in the $R_2T_{14}B$ main-phase crystal grains. Thus, the present invention has been accomplished.

That is, the present invention provides a rare earth based magnet comprising $R_2T_{14}B$ main-phase crystal grains and grain boundary phases formed between or among the $R_2T_{14}B$ main-phase crystal grains, wherein the $R_2T_{14}B$ main-phase crystal grains comprise a substance where the fine products are formed in the crystal grains, and in the section of the main-phase crystal grains, the longest line segment in the section is taken as the long axis of the grains, a line segment in the grain section that passes through the center of the grains and is perpendicular to the long axis is taken as the short axis; the lines which orthogonally divide the long axis and short axis into ¾ inward and ¼ outward are determined, and an ellipse tangent to the four lines is drawn with its long axis and short axis parallel to the long axis and short axis of the grains respectively; when the ellipse is regarded as the boundary, the grains are divided into the interior of the crystal grains which is the interior of the ellipse and the periphery of the crystal grains which is the exterior of the ellipse; the fine products are formed such that the number density in the interior of the crystal grains is larger than that in the periphery of the crystal grains. The number density referred herein is a section density of the number of the fine products in the section of the crystal grains.

The above fine products in the main-phase crystal grains are preferably non-magnetic, and more preferably, R-rich phase from the viewpoint of the production. When the fine products are non-magnetic, magnetic domain wall pinning can be effectively performed. Thus, the suppression on the rate of demagnetization at high temperature can be further enhanced. Moreover, by excessively comprising R which constitutes the $R_2T_{14}B$ main-phase crystal grains, R is produced therefrom and becomes the fine products consisted of R-rich phase, thereby simplifying the production.

The ratio of the number density of the above fine products in the interior of the main-phase crystal grains to that in the periphery of the main-phase crystal grains is preferably 3 or more, and more preferably 15 or more. By means of such a construction, the defective structures in the periphery of the main-phase crystal grains can be suppressed, the conventional occurrence of the reverse magnetic domain occurred in the periphery of the main-phase crystal grains can be inhibited, and a pinning mechanism for the magnetic domain wall can be supplemented in the main-phase crystal grains.

At this point, the grain boundary phases (two-grain boundary phases) formed between two adjacent $R_2T_{14}B$ main-phase crystal grains preferably has a thickness of 5 nm or more and 200 nm or less. By means of such a thickness of the grain boundary phases, the excessive element R located in the periphery of the $R_2T_{14}B$ main-phase crystal grains may be segregated in the grain boundary phases. Thus, the number density of the fine products in the periphery of the crystal grains can be reduced, and the grain boundary phases can be thickened, thereby inhibiting formation of the nuclei for generating the reverse magnetic domain, and improving the effect on cutting off the magnetic coupling between the adjacent $R_2T_{14}B$ main-phase crystal grains. If the thickness of the two-grain boundary phases is less than 5 nm, the magnetically cutting-off effect between the adjacent $R_2T_{14}B$ main-phase crystal grains becomes insufficient. On the other hand, if the thickness of the two-grain boundary phases exceeds 200 nm, the volume fraction of the grain boundary phases in the entire magnet becomes large, and thus the residual magnetic flux density decreases even though the effect on suppressing the rate of demagnetization at high temperature is enhanced. The method for evaluating the thickness of the two-grain boundary phases will be described later.

The above fine products are not required to be produced in all of the $R_2T_{14}B$ main-phase crystal grains. In other words, in the case of observing the section of the sintered body, it is unnecessary to confirm that all the $R_2T_{14}B$ main-phase crystal grains have the fine products. Since the larger the crystal grain, the easier the formation and movement of the magnetic domain wall, it is feasible that the fine products are formed in the large crystal grains in the sintered body. Even in such a case, the effect of the present invention can be produced. Moreover, the grain with a small section diameter is cut in the periphery of the crystal grain, and thus the interior of the crystal grain may be out of sight. Thus, evaluation of the number density of the fine products only for the large grains is enough.

According to the present invention, a rare earth based magnet with a small demagnetization rate at a high temperature can be provided, and a rare earth based magnet applicable in the motors and the like used in a high temperature environment can be provided.

BRIEF DESCRIPTION OF THE DRAWINGS

FIG. 1 is a drawing showing the section of the main-phase crystal grains and the grain boundary phases.

DETAILED DESCRIPTION OF EMBODIMENTS

Hereinafter, the preferred embodiments of the present invention are illustrated while making a reference to the drawings. Moreover, the rare earth based magnet according to the present invention is a sintered magnet comprising $R_2T_{14}B$ main-phase crystal grains and grain boundary phases, wherein, R contains one or more rare earth elements, and T contains one or more elements of iron group with Fe being an essential element. The magnet further comprises various well known additive elements.

FIG. 1 is an electron microscopic photograph showing the section structure of the rare earth based magnet of the embodiment according to the present invention. The rare earth based magnet according to this embodiment comprises $R_2T_{14}B$ main-phase crystal grains and grain boundary phases 3 formed between adjacent $R_2T_{14}B$ main-phase crystal grains, wherein, the $R_2T_{14}B$ main-phase crystal grain is consisted of an interior of the crystal grains 1 where the number density of the fine products is high and a periphery of the crystal grains 2 where the number density of the fine products is low. According to FIG. 1, a number of fine products are found in the interior of the crystal grains 1, while few fine products are found in the periphery of the crystal grains 2. The ratio of the number density of the fine products in the interior of the crystal grains 1 to that in the periphery of the crystal grains 2 approaches infinity.

The grain boundary phases 3 according to this embodiment have a width (thickness) of about 5~200 nm, which is formed to be extremely wide as compared to the width of the grain boundary phases of the conventional rare earth based magnet, 2~3 nm. It is unnecessary for the thickness of the grain boundary phases in the entire region surrounding the $R_2T_{14}B$ main-phase crystal grains to be within such a range. Even though there are areas with a small grain boundary phase thickness partially, the probability of occurrence of the reverse magnetic domain can be suppressed to be low by comprising the thick grain boundary phases described above in certain portion. The width of the grain boundary phases (the thickness of the grain boundary phases) according to the present invention refers to an average of measured values at 6 locations comprising 3 locations with a large thickness and 3 locations with a small thickness in the two-grain boundary phases. By means of such a construction, the magnetic coupling between the adjacent $R_2T_{14}B$ main-phase crystal grains is cut off. In the $R_2T_{14}B$ crystal grains, by controlling the conditions of the sintering process or the heat treating process following the sintering, the excessive element R in the periphery of the crystal grains is swept from the periphery of the crystal grains to the grain boundary phases, thereby forming wide grain boundary phases.

In the $R_2T_{14}B$ main-phase crystal grains constituting the rare earth based magnet according to this embodiment, the rare earth R may be light rare earth elements, heavy rare earth elements, or combination thereof, and may preferably be Nd, Pr or combination thereof from the viewpoint of costs of the materials. The iron-group element T is preferably Fe or combination of Fe and Co, and is not limited thereto. Moreover, B represents boron.

The rare earth based magnet according to this embodiment further comprises trace additive elements. As the additive elements, common additive elements may be used. The additive elements are preferably elements that have a eutectic point in the phase diagram with the constituting element R of the $R_2T_{14}B$ main-phase crystal grains. From this viewpoint, the additive elements are preferably Cu or the like, and may also be other elements. The adding amount of Cu is preferably 2 at % (atomic %) of the total or less. By allowing the adding amount to be within such a range, Cu can generally unevenly distribute only in the grain boundary phases.

By adding Cu in the rare earth based magnet, R—Cu liquid phase can be formed in the sintering or heat treating processes, which constitutes wide and smooth grain boundary phases (two-grain boundary phases), thereby inhibiting production of the fine products in the periphery of the $R_2T_{14}B$ main-phase crystal grains, and facilitating production of fine products in the interior of the crystal grains.

In the composition of the rare earth based magnet according to this embodiment, in comparison to the element T, the element R is excessive than the stoichiometric ratio of $R_2T_{14}B$. Specifically, the atomic percentage of R may be around 14.4%.

An example of the method for producing the rare earth based magnet according to this embodiment is described. The rare earth based magnet according to this embodiment may be produced by a conventional powder metallurgic method comprising a confecting process of confecting the alloy raw materials, a pulverizing process of pulverizing the alloy raw materials into micro powder raw materials, a molding process of molding the micro powder raw materials into a molded body, a sintering process of sintering the molded body into a sintered body, and a heat treating process of subjecting the sintered body to an aging treatment.

The confecting process is a process for confecting the alloy raw materials that contain respective elements contained in the rare earth based magnet according to this embodiment. Firstly, the raw metals having the specified elements are prepared, and subjected to a strip casting method and the like. The alloy raw materials are thus confected. As the metal raw materials, for examples, rare earth metals or rare earth alloys, pure iron, ferroboron or alloys thereof can be exemplified. These metal raw materials are used to confect the alloy raw materials of the rare earth based magnet having the desired composition.

The pulverizing process is a process for pulverizing the alloy raw materials obtained in the confecting process into micro powder raw materials. This process is preferably performed in two stages comprising a coarse pulverization and a fine pulverization, and may also be performed as one stage. The coarse pulverization may be performed by using, for example, a stamp mill, a jaw crusher, a braun mill, etc under an inert atmosphere. A hydrogen decrepitation in which pulverization is performed after hydrogen adsorption may also be performed. In the coarse pulverization, the alloy raw materials are pulverized until the particle size is around several hundreds of micrometers to several millimeters.

The fine pulverization finely pulverizes the coarse powders obtained in the coarse pulverization, and prepares the micro powder raw materials with the average particle size of several micrometers. The average particle size of the micro powder raw materials may be set under the consideration of the growth of the crystal grains after sintering. For example, the fine pulverization may be performed by a jet mill.

The molding process is a process for molding the micro powder raw materials into a molded body in the magnetic field. Specifically, after the micro powder raw materials are filled into a mold equipped in an electromagnet, the molding is performed by orientating the crystallographic axis of the micro powder raw materials by applying a magnetic field via the electromagnet, while pressurizing the micro powder raw materials. The molding may be performed in a magnetic field of 1000~4600 kA/m under a pressure of 30~300 MPa.

The sintering process is a process for sintering the molded body into a sintered body. After being molded in the magnetic field, the molded body may be sintered in a vacuum or an inert atmosphere to obtain a sintered body. Preferably, the sintering conditions are suitably set depending on the conditions such as composition of the molded body, the pulverizing method of the micro powder raw materials, particle size. For example, the sintering may be performed at 1000° C.~1100° C. for 1~10 hours.

The heat treating process is a process for subjecting the sintered body to an aging treatment. After this process, the fine products in the $R_2T_{14}B$ main-phase crystal grains and the width of the two-grain boundary phases are determined. However, these microstructures are not only controlled in this process, but are determined by considering both the conditions of the above sintering process and the situation of the micro powder raw materials. Hence, the temperature and time period for the heat treatment can be set under the consideration of the relationship between the conditions of the heat treatment and the microstructure of the sintered body. The heat treatment may be performed at a temperature of 550° C.~800° C., and may also be performed in two stages comprising a heat treatment in the vicinity of 800° C. followed by a heat treatment in the vicinity of 550° C. The cooling rate(s) during the cooling process of the heat treatment may also alter the microstructure. The cooling rate is preferably 100° C./min or more, particularly preferably 300° C./min or more. By the above aging of the present invention in which the cooling is faster than the prior art, the segregation of the ferromagnetic phase in the grain boundary phases can be effectively inhibited. Thus, the causes for reducing the coercivity and further deteriorating the rate of demagnetization at high temperature can be eliminated. In the heat treatment in the vicinity of 800° C. distribution of the fine products and the like can be controlled by setting various time periods for heat treatment. Next, by rapid cooling, the distribution of the fine products formed in the crystal gains can be fixed.

The rare earth based magnet according to this embodiment can be obtained via the above methods. However, the producing method for the rare earth based magnet is not limited to the above methods and can be suitably modified.

Next, the evaluation for the rate of demagnetization at high temperature of the rare earth based magnet according to this embodiment is described. The shape of the sample used for evaluation is not particularly limited, and for example, is generally a shape with a magnetic permeance coefficient of 2. Firstly, residual flux of the sample at a room temperature (25° C.) is measured and taken as B0. The residual flux may be measured by for example a magnetic flux meter. Next, the sample is exposed to a high temperature of 140° C. for 2 hours, and back to the room temperature. Once the temperature of the sample returns to the room temperature, the residual flux is measured again and taken as B1. As such, the rate of demagnetization at high temperature D is evaluated by the formula below.

$$D=(B1-B0)/B0*100(\%)$$

The microstructure of the rare earth based magnet according to this embodiment may be evaluated via a transmission electron microscope. The above sample for which the high-temperature demagnetization rate has been evaluated is prepared into a thin-sheet shape, and the grinded section is observed. The grinded section may be parallel to the orientation axis, perpendicular to the orientation axis, or form an arbitrary angle with the orientation axis. The electron microscopic images are obtained at 5,000× magnification to evaluate the distribution of the fine products in the section of the $R_2T_{14}B$ main-phase crystal grains. Specifically, the biggest main-phase crystal grain in the visual field is selected. The longest line segment in the section of the grain is taken as the long axis, and a line segment in the grain section that passes through the center of the grain and is perpendicular to the long axis is taken as the short axis. The lines which respectively orthogonally divide the long axis and short axis of the grain into ¾ inward and ¼ outward are determined. The crystal grain is divided into an interior and a periphery by drawing an ellipse tangent to the four lines with its long axis and short axis paralleling to the long axis and short axis of the grain respectively. The sectional area of the section of the crystal grain may be obtained by for example the image processing of the electron microscopic images, and the sectional area of the interior of the crystal grain may be obtained as the area of the above approximate ellipse. Hence, the sectional area of the periphery of the crystal grain may be obtained as a difference of the above two areas.

The width of the two-grain boundary phases between the adjacent $R_2T_{14}B$ main-phase crystal grains may be evaluated via high-resolution transmission electron microscopy (HRTEM). The magnification is preferably about 1 million in the case where the thickness of the two-grain boundary phases is in a several-nanometer scale, and may be suitably set according to the width of the two-grain boundary phases of the observed object. In this embodiment, with respect to the focused two-grain boundary phases that surround the $R_2T_{14}B$ main-phase crystal grains, an average of measured values at 6 locations comprising 3 locations with a large thickness and 3 locations with a small thickness is taken as the width of the grain boundary phases.

In addition, O contained in the resultant rare earth based magnet may be measured by an inert gas fusion-nondispersive infrared absorption method, C may be measured by a combustion in oxygen flow-infrared absorption method, N may be measured by an inert gas fusion-thermal conductivity method. The composition of the rare earth based magnet according to this embodiment is formed preferably such that, in comparison to the element T, the element R is excessive than the stoichiometric ratio of $R_2T_{14}B$. Further, when the number of atoms C, O and N contained are indicated as [C], [O], and [N], respectively, the relationship of $[O]/([C]+[N])<0.60$ is satisfied. With such a composition, the absolute value of the rate of demagnetization at high temperature can be suppressed to be small.

The present invention will be described below in more detail with reference to the specific examples, but is not limited thereto.

EXAMPLES

Nd was used as the element R, and Fe was used as the element T. The metal raw materials of the rare earth based magnet were prepared and produced into the alloy raw materials with the following composition by a strip casting method.

Nd: 31.09 mass %,
B: 0.89 mass %,
Cu: 0.02 mass %,
Fe: balance (the residual part except for the inevitable impurities is Fe), and
other inevitable impurities, 1 mass % or less.

Next, after adsorption of hydrogen onto the resultant alloy raw materials, a hydrogen pulverization for desorbing hydrogen was performed in Ar atmosphere at 600° C. for 1 hour. Then the resultant pulverized material was cooled to room temperature in Ar atmosphere.

After adding oleic acid amide as the pulverization agent to the resultant pulverized material and mixing therewith, a fine pulverization was performed by using a jet mill to obtain powder raw materials with an average particle size of about 4 μm.

The resultant powder raw materials were molded in a low-oxygen atmosphere under a condition of an orientating magnetic field of 1200 kA/m and a molding pressure of 120 MPa to obtain a molded body.

Then, the molded body was sintered in a vacuum at 1060° C. for 3 hours, and quenched to obtain a sintered body.

For the resultant sintered body, a two-stage heat treatment comprising one at 800° C. and the other one at 540° C. was performed. With respect to the second stage of heat treatment at 540° C., the heat treatment was performed for 2 hours, and the cooling rate during the cooling process was set to be 100° C./min. With respect to the first stage of heat treatment at 800° C. by varying the time period and cooling rate during the cooling process of the heat treatment, Experiments 1~6 were performed according to the conditions of the first stage of heat treatment, and a quantity of samples with different distributions of the fine products in the crystal grains were prepared.

With respect to the samples obtained as above, the rate of demagnetization at high temperature was first measured, and then the section was observed by an electron microscope, followed by determination of the distribution of the fine products in the main-phase crystal grains and the width of the two-grain boundary phases. Moreover, the components of the fine products in the main-phase crystal grains were identified by energy-dispersive X-ray spectroscopy, confirming that the fine products in the main-phase crystal grains were a phase in which the concentration of the non-magnetic rare earth element Nd was relatively high (Nd-rich phase) in all cases. The results were shown in Table 1.

Additionally, when the number of atoms of the elements N, C and O contained in the resultant rare earth based magnet were indicated as [N], [C], and [O], respectively, the values of $[O]/([C]+[N])$ for respective samples were calculated and shown in Table 2. The amounts of oxygen and nitrogen contained in the rare earth based magnet were adjusted to the ranges shown in Table 2 by controlling the atmospheres from the pulverizing process to the heat treating process, especially adjusting the amounts of oxygen and nitrogen contained in the atmosphere in the pulverizing process. Moreover, the amount of carbon contained in the raw material of the rare earth based magnet was adjusted to the range shown in Table 2 by adjusting the amount of the pulverization agent added in the pulverizing process.

TABLE 1

| Sample No. | Number density of fine products: Interior of crystal grains (/μm²) | Number density of fine products: Periphery of crystal grains (/μm²) | Ratio of number densities of interior to periphery | Fine products | Width of two-grain boundary phases (nm) | High temperature demagnetization rate |
|---|---|---|---|---|---|---|
| Experiment 1 | 4.01 | 0.09 | 44.6 | Nd-rich phase | 190 | −0.3 |
| Experiment 2 | 3.67 | 0.18 | 20.4 | Nd-rich phase | 140 | −0.5 |
| Experiment 3 | 3.44 | 0.18 | 19.1 | Nd-rich phase | 86 | −1.3 |
| Experiment 4 | 2.63 | 0.18 | 14.6 | Nd-rich phase | 21.3 | −1.5 |
| Experiment 5 | 2.29 | 0.46 | 5.0 | Nd-rich phase | 7.3 | −1.8 |
| Experiment 6 | 1.37 | 0.46 | 3.0 | Nd-rich phase | 4.9 | −1.9 |
| Experiment 7 | 0.34 | 0.37 | 0.9 | Nd-rich phase | 2.3 | −5.5 |
| Experiment 8 | 0.00 | 0.00 | — | — | 1.9 | −7.6 |

TABLE 2

| Sample No. | Amounts of N, C and O contained in the rare earth based magnet: N mass % | C mass % | O mass % | Ratio of number of atoms [O]/([C] + [N]) | Cooling rate of the first stage of heat treatment ° C./min |
|---|---|---|---|---|---|
| Experiment 1 | 0.05 | 0.09 | 0.08 | 0.45 | 300 |
| Experiment 2 | 0.05 | 0.09 | 0.09 | 0.51 | 300 |
| Experiment 3 | 0.05 | 0.09 | 0.10 | 0.57 | 100 |
| Experiment 4 | 0.05 | 0.09 | 0.10 | 0.57 | 100 |
| Experiment 5 | 0.05 | 0.09 | 0.08 | 0.45 | 100 |
| Experiment 6 | 0.05 | 0.09 | 0.08 | 0.45 | 300 |
| Experiment 7 | 0.05 | 0.09 | 0.11 | 0.62 | 60 |
| Experiment 8 | 0.05 | 0.09 | 0.11 | 0.62 | 10 |

It could be seen from Table 1 that, in the sample group of Experiments 1-6 where the number density of the fine products in the interior of the crystal grains is larger than that in the periphery of the crystal grains, by allowing the ratio of the number density of the fine products in the interior of the crystal grains to that in the periphery of the crystal grains to be 3 or more, the rate of demagnetization at high temperature may be suppressed to be within −2.0%, thus forming a rare earth based magnet applicable for use in a high temperature environment. Further, it could be seen from Experiments 1-4 that, by allowing the ratio of the number density of the fine products in the interior of the crystal grains to that in the periphery of the crystal grains to be 15 or more, the rate of demagnetization at high temperature may be suppressed to be within −1.5%.

When focusing on the width of the two-grain boundary phases shown in Table 1, the rare earth based magnet with a microstructure in which the two-grain boundary phases have a width of 4.9 nm (about 5 nm) or more produced an effect on suppressing the rate of demagnetization at high temperature in the present example (Experiments 1-6). The reason was considered to be that the fine products were formed in the interior of the crystal grains, and the excessive Nd atom originally located in the periphery of the crystal grains was not occurred in the periphery of the crystal grains, but segregated in the two-grain boundary phases. Further, by imparting such a microstructure to the rare earth based magnet, the magnetic coupling between the main-phase crystal grains could be cut off, meanwhile, an magnetic domain wall pinning effect was produced, and the rate of demagnetization at high temperature could be significantly suppressed.

In another aspect, samples for comparison (Experiments 7 and 8) were prepared in accordance with the implementing conditions of Patent Document 3. In the comparative example (Experiment 7) of Table 1, number density of the fine products in the periphery of the crystal grains was larger than that in the interior of the crystal grains, which did not form the microstructure of the present invention. The width of the two-grain boundary phases was at the same level as the prior art, and thus the rate of demagnetization at high temperature could not be suppressed. In the comparative example (Experiment 8), when observing at the above magnification, the fine products could not be confirmed either in the interior of the crystal grains or in the periphery of the crystal grains. The width of the two-grain boundary phases was at the same level as the prior art, too. Thus, the rate of demagnetization at high temperature could not be suppressed.

In addition, as shown in Table 2, in the samples of Examples 1-6 that meet the requirements of the present invention, the above microstructure was formed in the sintered magnet, and the number of atoms O, C and N contained in the sintered magnet satisfied the following specific relationship. That is, when the number of atoms O, C and N were indicated as [O], [C], and [N], respectively, the relationship of $[O]/([C]+[N])<0.60$ was satisfied. As such, when $[O]/([C]+[N])<0.60$, the rate of demagnetization at high temperature D can be suppressed effectively.

The present invention was described with reference to the embodiments. The embodiments were exemplified, and may be modified and varied within the scope of the claims of the present invention. In addition, those skilled in the art should understand that the modified examples and variations are within the scope of the claims of the present invention. Thus, the description of the present specification and the drawings should be considered as illustrative but not limited.

According to the present invention, a rare earth based magnet that is applicable in a high temperature environment may be provided.

DESCRIPTION OF REFERENCE NUMERALS

1 Interior of crystal grains
2 Periphery of crystal grains
3 Grain boundary phases

What is claimed is:

1. A rare earth based magnet, comprising, $R_2T_{14}B$ main-phase crystal grains and two-grain boundary phases between the $R_2T_{14}B$ main-phase crystal grains, wherein said $R_2T_{14}B$ main-phase crystal grains comprise a substance where fine products are formed in the crystal grains, in the section of the main-phase crystal grains, the longest line segment in the section is taken as the long axis of the grains, a line segment in the grain section that passes through the center of the grains and is perpendicular to the long axis is taken as the short axis; the lines which orthogonally divide the long axis and short axis into ¾ inward and ¼ outward are determined, and an ellipse tangent to the four lines is drawn with its long axis and short axis parallel to the long axis and short axis of the grains respectively; when the ellipse is regarded as the boundary, the grains are divided into the interior of the crystal grains which is the interior of the ellipse and the periphery of the crystal grains which is the exterior of the ellipse; the fine products are formed such that the number density in the interior of the crystal grains is larger than that in the periphery of the crystal grains, when the number density of said fine products in said interior of the crystal grains is taken as A1 and the number density of said fine products in said periphery of the crystal grains is taken as A2, $A1/A2 \geq 3.0$, and wherein, said two-grain boundary phases have a width of 5 nm or more and 200 nm or less.

2. The rare earth based magnet according to claim 1, wherein, $$A1/A2 \geq 15.$$

3. The rare earth based magnet according to claim 1, wherein, said fine products are non-magnetic Nd-rich phase.

4. The rare earth based magnet according to claim 2, wherein, said fine products are non-magnetic Nd-rich phase.

5. The rare earth based magnet according to claim 1, wherein, $30 \leq A1/A2 \leq 44.6$.

6. The rare earth based magnet according to claim 2, wherein, $15 \leq A1/A2 \leq 44.6$.

7. The rare earth based magnet according to claim 1, wherein, the rare earth based magnet contains C, O and N, and when the number of atoms C, O and N contained are indicated as [C], [O] and [N], $[O]/([C]+[N]) < 0.60$.

8. The rare earth based magnet according to claim 3, wherein, the rare earth based magnet contains C, O and N, and when the number of atoms C, O and N contained are indicated as [C], [O] and [N], $[O]/([C]+[N]) < 0.60$.

9. The rare earth based magnet according to claim 1, wherein, the rare earth based magnet contains C, O and N, and when the number of atoms C, O and N contained are indicated as [C], [O] and [N], $0.45 \leq [O]/([C]+[N]) \leq 0.57$.

10. The rare earth based magnet according to claim 2, wherein, the rare earth based magnet contains C, O and N, and when the number of atoms C, O and N contained are indicated as [C], [O] and [N], $0.45 \leq [O]/([C]+[N]) \leq 0.57$.

* * * * *